US006237891B1

(12) United States Patent
Stiner et al.

(10) Patent No.: US 6,237,891 B1
(45) Date of Patent: May 29, 2001

(54) ADAPTOR FOR USE OF ALTERNATE GAS FUEL

(75) Inventors: Roy Stiner, Owasso; Brenton McLaury; Bruce McCorkle, both of Tulsa, all of OK (US)

(73) Assignee: Burnswick Corporation, Lake Forest, IL (US)

( * ) Notice: Subject to any disclaimer, the term of this patent is extended or adjusted under 35 U.S.C. 154(b) by 0 days.

(21) Appl. No.: 09/391,971

(22) Filed: Sep. 8, 1999

(51) Int. Cl.[7] ..... F23D 14/28; F16K 51/00

(52) U.S. Cl. ..... 251/149.6; 138/44; 431/344

(58) Field of Search ..... 251/149.6; 138/44; 431/344

(56) References Cited

U.S. PATENT DOCUMENTS

| | | | | |
|---|---|---|---|---|
| 2,777,716 | * | 1/1957 | Gray | 285/276 |
| 2,919,935 | * | 1/1960 | Nyberg | 251/18 |
| 3,140,740 | | 7/1964 | Lagreid et al. . | |
| 3,294,079 | | 12/1966 | Thompson . | |
| 3,352,531 | * | 11/1967 | Kilmarx | 251/149.6 |
| 3,406,942 | * | 10/1968 | Bocceda | 251/149.4 |
| 3,574,505 | | 4/1971 | Kimball . | |
| 3,704,002 | * | 11/1972 | Skarzynski | 251/149.6 |
| 3,877,458 | | 4/1975 | Allander . | |
| 3,900,281 | | 8/1975 | Penberthy . | |
| 3,933,146 | | 1/1976 | Hastings . | |
| 4,092,974 | | 6/1978 | Zenzaburo . | |
| 4,545,759 | | 10/1985 | Giles et al. . | |
| 4,954,075 | | 9/1990 | Francino . | |
| 5,535,985 | * | 7/1996 | Laruisson | 251/149.9 |
| 5,803,727 | | 9/1998 | Long . | |
| 5,860,410 | | 1/1999 | Hollingsworth, Jr. . | |
| 5,890,887 | | 4/1999 | Adler . | |

* cited by examiner

*Primary Examiner*—Kevin Shaver
*Assistant Examiner*—David A. Bonderer
(74) *Attorney, Agent, or Firm*—Dennis D. Brown; Fellers, Snider, Blankenship, Bailey & Tippens

(57) ABSTRACT

A device for supplying an alternate gas fuel to a gas-burning apparatus such that the gas-burning apparatus will receive and burn the alternate gas fuel, the gas-burning apparatus being of a type intended to burn a gas fuel which is different from the alternate fuel and is supplied at a pressure substantially different from that of the alternate fuel. The inventive device comprises: an inlet coupling attachable to a discharge fitting provided on the alternate fuel container and an outlet coupling downstream of the inlet coupling and attachable to an inlet fitting provided on the gas-burning apparatus. When the pressure of the alternate gas fuel is significantly greater than that of the intended fuel, the inventive device preferably also includes a restricting element for restricting flow of the alternate fuel through the device from the inlet coupling to the outlet coupling.

3 Claims, 4 Drawing Sheets

ADAPTOR FOR USE OF ALTERNATE GAS FUEL

FIELD OF THE INVENTION

This application relates to devices for converting gas-burning devices from the use of intended gas fuels to other gas fuels. More particularly, but not by way of limitation, this invention relates to devices for converting from the use of intended gas fuels to the use of alternate gas fuels supplied at substantially different pressures.

BACKGROUND OF THE INVENTION

Portable gas stoves, lanterns, and other appliances used for camping, backpacking, etc., are typically fueled by either propane or butane. Most such appliances purchased and used in the United States are designed to burn propane. However, throughout the rest of the world, most of these devices are designed to burn butane.

Portable butane appliances operate at much lower pressures than do portable propane devices. Typical propane supply pressures can be greater than two, two and one-half, three, and even greater than four times higher than typical butane supply pressures. The pressure of a butane supply container used for portable butane burning devices will typically be in the range of from about 30 to about 60 psig. However, the pressure of a propane supply container used for portable propane-burning devices will typically be in the range of from about 125 to about 200 psig.

In addition, the discharge fittings provided on small propane containers used for camping, backpacking, etc., are typically different from those used on butane containers. Moreover, the inlet fittings on butane-burning devices are typically different from those used on propane-burning devices.

It would be very beneficial to convert the U.S. camping market from propane burning devices to butane burning devices. Because they operate at much lower supply pressures, butane devices are safer and more economical than propane devices. Additionally, unlike propane appliances, butane devices can be used substantially worldwide. Unfortunately, however, a switch to butane devices in the United States has not been practical in view of the fact that butane canisters for camping and backpacking are not readily available. Moreover, it is not foreseeable that such compact butane supply canisters will become available in the U.S. market until a substantial number of butane devices are placed in use.

Thus, a need presently exists for a device for converting gas burning devices from the use of intended gas fuels to other gas fuels. In particular, a need presently exists for a very compact device which will allow portable butane stoves, lanterns, and other appliances for camping, backpacking, etc., to receive and burn propane supplied from the small, camp-type fuel containers presently available on the market. The availability of such a device would allow butane-burning devices sold in the U.S. market to be powered by propane until such time as appropriate butane supplies are readily available. Additionally, the device would allow butane devices to be used in any region of the world where propane is the predominate fuel of choice.

SUMMARY OF THE INVENTION

The present invention provides a device which addresses the needs and alleviates the problems discussed above. The device is operable for supplying an alternate gas fuel to a gas-burning apparatus constructed to receive and burn an intended gas fuel, wherein the alternate gas fuel is different from and is supplied at a pressure significantly greater or significantly less than that of the intended gas fuel. The device comprises (a) an inlet coupling attachable to a discharge fitting provided on a fuel source for the alternate gas fuel and (b) an outlet coupling, downstream of the inlet coupling, which is attachable to a gas inlet fitting provided on the gas-burning apparatus. Thus, the inventive device is operable such that the gas-burning apparatus will receive and burn the alternate gas fuel.

In one aspect of the present invention wherein the source pressure of the alternate gas fuel is significantly greater than the supply pressure of the intended gas fuel, the inventive device further comprises limiting means for limiting flow of the alternate gas fuel through the device from the fuel source to the gas-burning apparatus.

In another aspect, the present invention provides a device for supplying propane fuel to a butane-burning apparatus such that the butane-burning apparatus will receive and burn the propane fuel. The butane-burning apparatus is an apparatus constructed to receive and burn butane from a butane container having a butane supply pressure which is substantially less than the propane supply pressure. The inventive device comprises: an inlet coupling attachable to a propane discharge fitting provided on the propane container; an outlet coupling downstream of the inlet coupling and attachable to a butane inlet fitting provided on the butane-burning apparatus; and limiting means for limiting flow of the propane through the device from the inlet coupling to the outlet coupling.

Further objects, features, and advantages of the present invention will be apparent upon examining the accompanying drawings and upon reading the following description of the preferred embodiments.

DETAILED DESCRIPTION OF THE PREFERRED EMBODIMENTS

Figure 1:
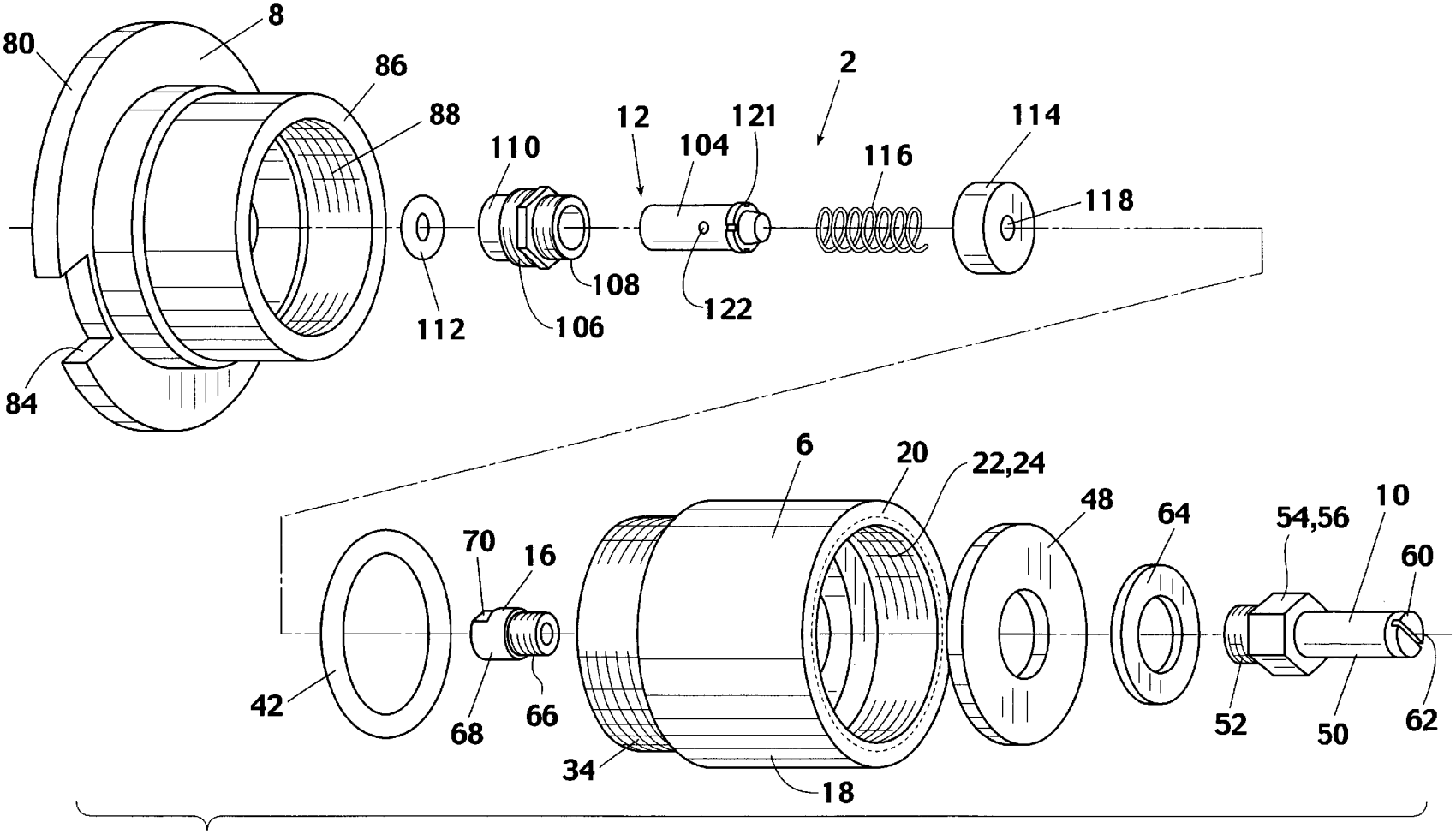
FIG. 1 provides an exploded view of an embodiment 2 of an adaptor provided by the present invention.
Figure 2:
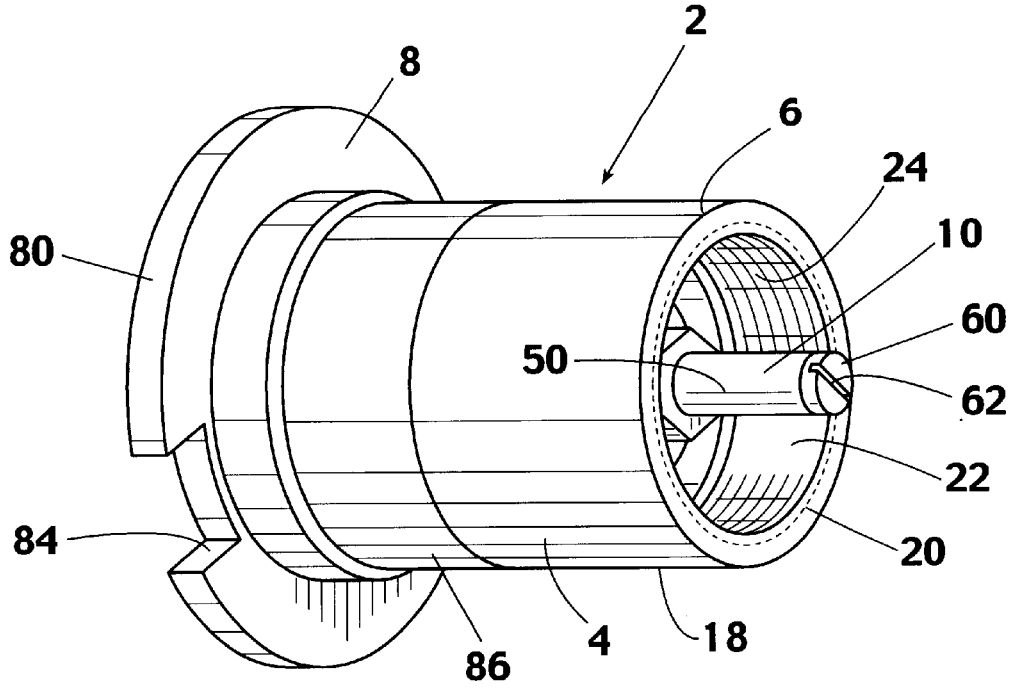
FIG. 2 provides a perspective inlet end view of inventive adaptor 2.
Figure 3:
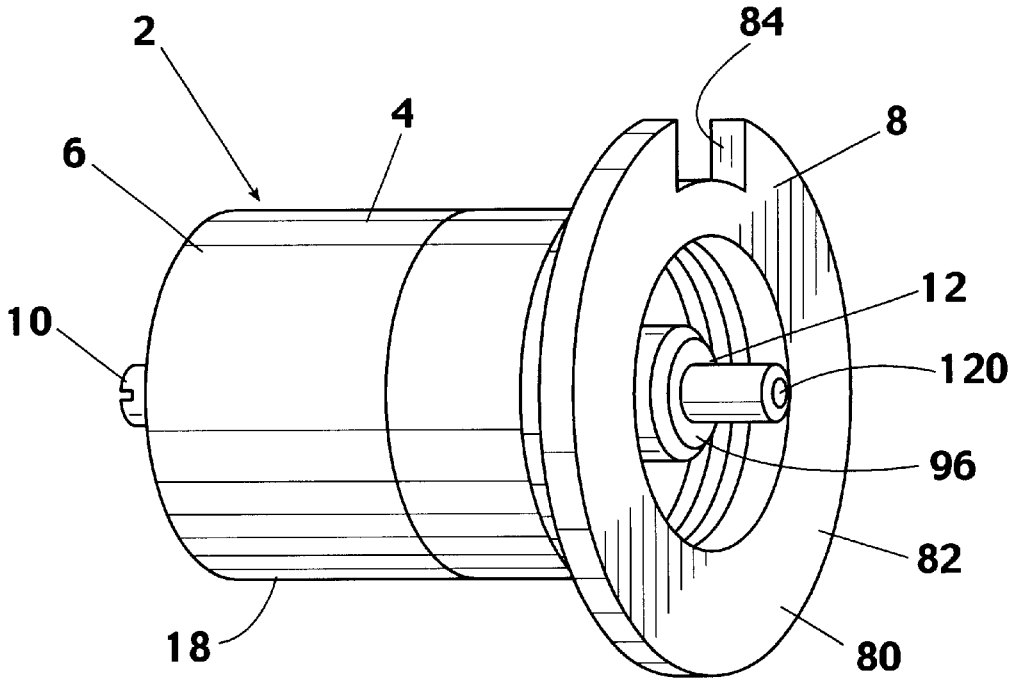
FIG. 3 provides a perspective outlet end view of inventive adaptor 2.
Figure 4:
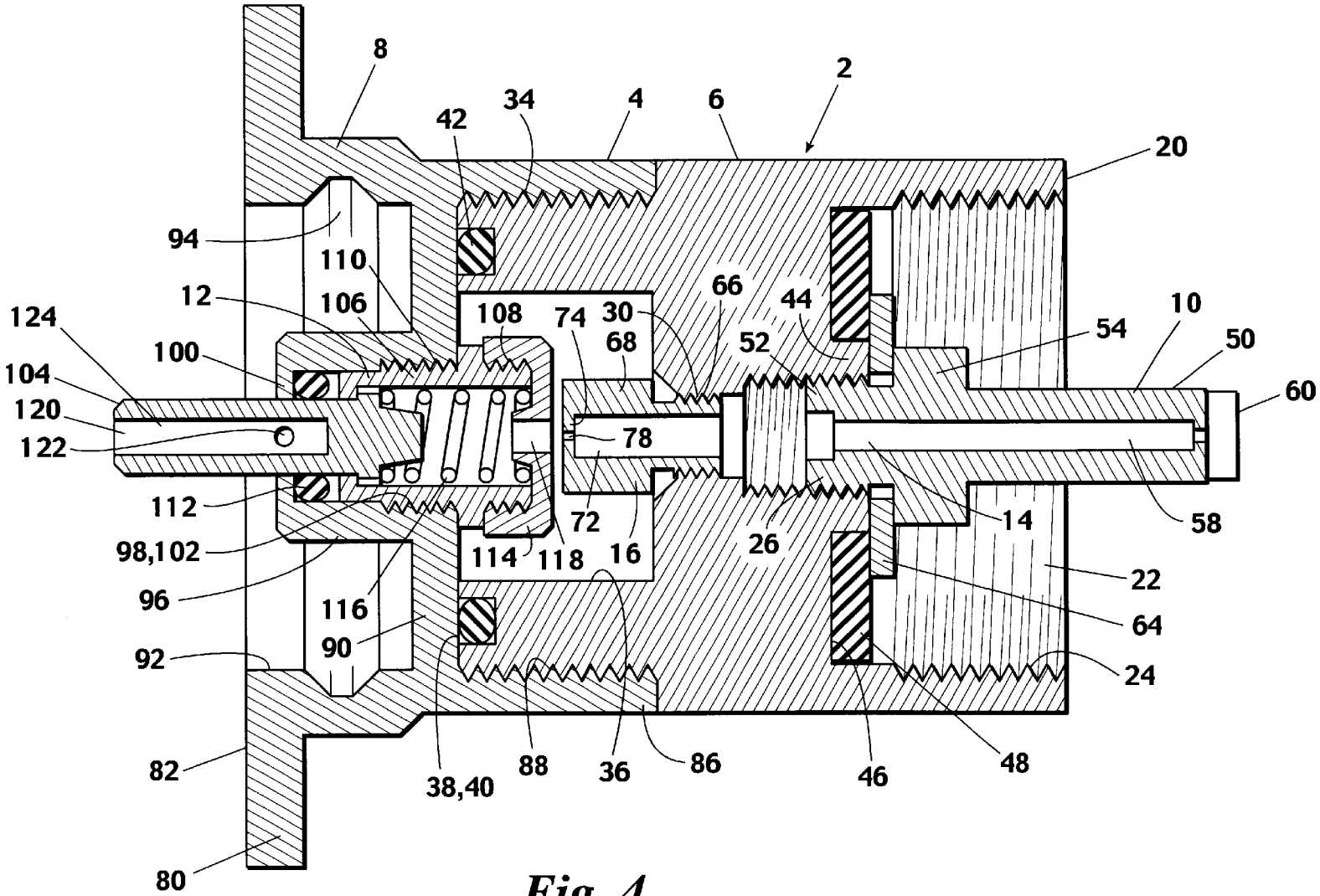
FIG. 4 provides a cutaway, elevational side view of inventive adaptor 2 wherein the outlet valve 104 thereof is in closed position.

An embodiment 2 of the inventive adaptor is depicted in FIGS. 1–5. Embodiment 2 is particularly well suited for adapting a butane-burning device to the use of propane fuel. Inventive adaptor 2 comprises: a housing 4 including an inlet fitting/coupling 6 removably attached to an outlet fitting/coupling 8; a probe 10 projecting from inlet fitting 6; a valve assembly 12 projecting from outlet fitting 8; a flow passage 14 extending through probe 10 and housing 4 to valve assembly 12; and an orifice element 16 positioned in flow passageway 14 between probe 10 and valve assembly 12.

Inlet fitting 6 and probe 10 are of a type structured for attachment to and activation of most of the small, camping-type propane canisters available on the market. However, as will be apparent, generally any type of attachment structure and activation element can be used depending upon the structure of the fuel supply container to which inventive adaptor 2 is to be attached.

The inlet fitting 6 depicted in FIGS. 1–5 comprises: a larger diameter, cylindrical rearward section 8 having a rearward end 20; a large diameter rearward bore 22 having internal threads 24 formed therein for releasable attachment to an externally-threaded propane discharge fitting; a threaded second bore 26 extending from the forward end of large bore 22; a threaded third bore 30 extending from the forward end of second bore 26; an externally threaded forward section 34 extending from rearward section 18 and having an external diameter smaller than that of section 18; a bore 36 extending into the forward end 38 of externally threaded section 34; a small, frusto15 conical counter bore extending from forward bore 36 to third bore 30; and a groove 40 formed in the forward end 38 of inlet fitting 6 for receiving an O-ring 42 or other sealing element.

Inlet fitting 6 further includes a raised lip or hub 44 provided around the rearward end of second bore 26. Thus, a flat radial groove 46 is formed at the forward end of large bore 22 for receiving a rubber gasket 48 or other sealing element. When the discharge fitting of the propane canister is threadedly received in large bore 22, gasket 48 seals against the end of the propane discharge fitting.

Probe 10 comprises: an elongate segment 50 which projects from the rearward end 20 of inlet fitting 6; a threaded forward segment 52 which is threadedly received in second bore 26; an enlarged segment 54 between rearward segment 50 and forward segment 52 and having flats 56 provided thereon for tightening threaded segment 52 into second bore 26; a longitudinal flow channel 58 extending through probe 10; and a cap 60 provided on he distal end of rearward segment 50. A lateral slot 62 is provided across cap 60 in fluid communication with the rearward end of longitudinal flow channel 58. When the forward end 52 of probe 10 is received in interior threaded bore 26 of inlet fitting 6, a washer 64 is preferably positioned between the enlarged segment 54 of probe 10 and the end of the lip/hub 44 formed in large bore 22. Washer 64 preferably extends radially a sufficient distance to hold gasket 48 in groove 46.

The discharge fittings of propane canisters of the type used for camping will typically include a valve stem which is surrounded by an externally threaded coupling. Propane is released from the canister when the valve stem is depressed inwardly. Thus, probe 10 is constructed to interact with valve elements of this type such that, as the large threaded bore 22 of inlet fitting 6 is screwed on to the discharge fitting of the propane canister, the cap 60 of probe 10 contacts the forward end of the propane valve stem and eventually depresses the propane valve stem a sufficient distance to cause propane to be released from the canister. The released propane flows through the lateral slot 62 of probe cap 60 and into longitudinal flow channel 58.

Orifice element 16 comprises: an externally threaded rearward section 66 which is received in the small, threaded, bore 30 of inlet fitting 6; a larger diameter forward section 68 having flats 70 provided on the exterior thereof for tightening orifice element 16 into threaded bore 30; a longitudinal flow channel 72 provided through orifice element 16; and an end wall, cap, plug or other element 74 provided at the forward end of, or elsewhere in, orifice element 16 and having a small flow restriction orifice 78 formed therethrough. Orifice 78 is in fluid communication with the flow channel 72 of orifice element 16. Orifice 78 is sized to restrict the flow of propane from the propane canister and reduce the pressure of the flowing propane sufficiently to enable the propane fuel to be used in the butane-burning device to which the other end of inventive adaptor is attached.

The outlet fitting/coupling 8 and the valve assembly 12 of embodiment 2 of the inventive adaptor 2 are structured to attach to a gas inlet fitting of a type commonly employed on butane-burning camp devices. Outlet fitting 8 includes a radial flange 80 on the forward end 82 thereof. A slot 84 is provided in radial flange 80 for receiving a post which will typically be included in the appliance fitting. Outlet fitting 8 can thus be secured to the appliance by positioning the post of the appliance in slot 84 and rotating the inventive adaptor a quarter turn. As will be understood by those skilled in the art, the appliance fitting will typically include a plurality of fingers or latches which contract onto and grasp flange 80 as the adaptor is turned.

Outlet fitting 8 further comprises: a rearward segment 86 having an internally threaded bore 88 for threadedly receiving the forward end 34 of inlet fitting 6; an interior radial wall 90 provided at the forward end of threaded bore 88; a forward bore 92 extending into the forward end 82 of outlet fitting 8; an annular groove 94 formed in forward bore 92 for receiving an O-ring or other sealing element associated with the appliance fitting; a hub 96 extending from interior radial wall 90 into forward bore 92; a passageway 98 extending through interior wall 90 and hub 96; and a radial lip 100 provided at the forward end of hub 96 and projecting into passage 98. Internal threads 102 are provided in at least the rearward portion of passage 98.

Valve assembly 12 comprises: a valve stem 104 which projects from the forward end of hub 86; a valve cage 106 which slidably receives and retains an enlarged rearward portion 121 of valve stem 104 and which includes an externally threaded forward portion 110 which is received in threaded hub 96; an O-ring or other sealing element 112 positioned in hub 96 between hub lip 100 and the forward end of valve cage 106; a cap 114 threadedly secured over the rearward end of valve cage 106; and a spring 116 contained within cage 106 between cap 114 and the enlarged rearward portion 121 of valve stern 104. Spring 116 continuously urges valve stem 104 outwardly. Cap 114 has a port 118 provided therethrough which allows gas to flow from orifice element 16 into valve cage 106.

Figure 5:
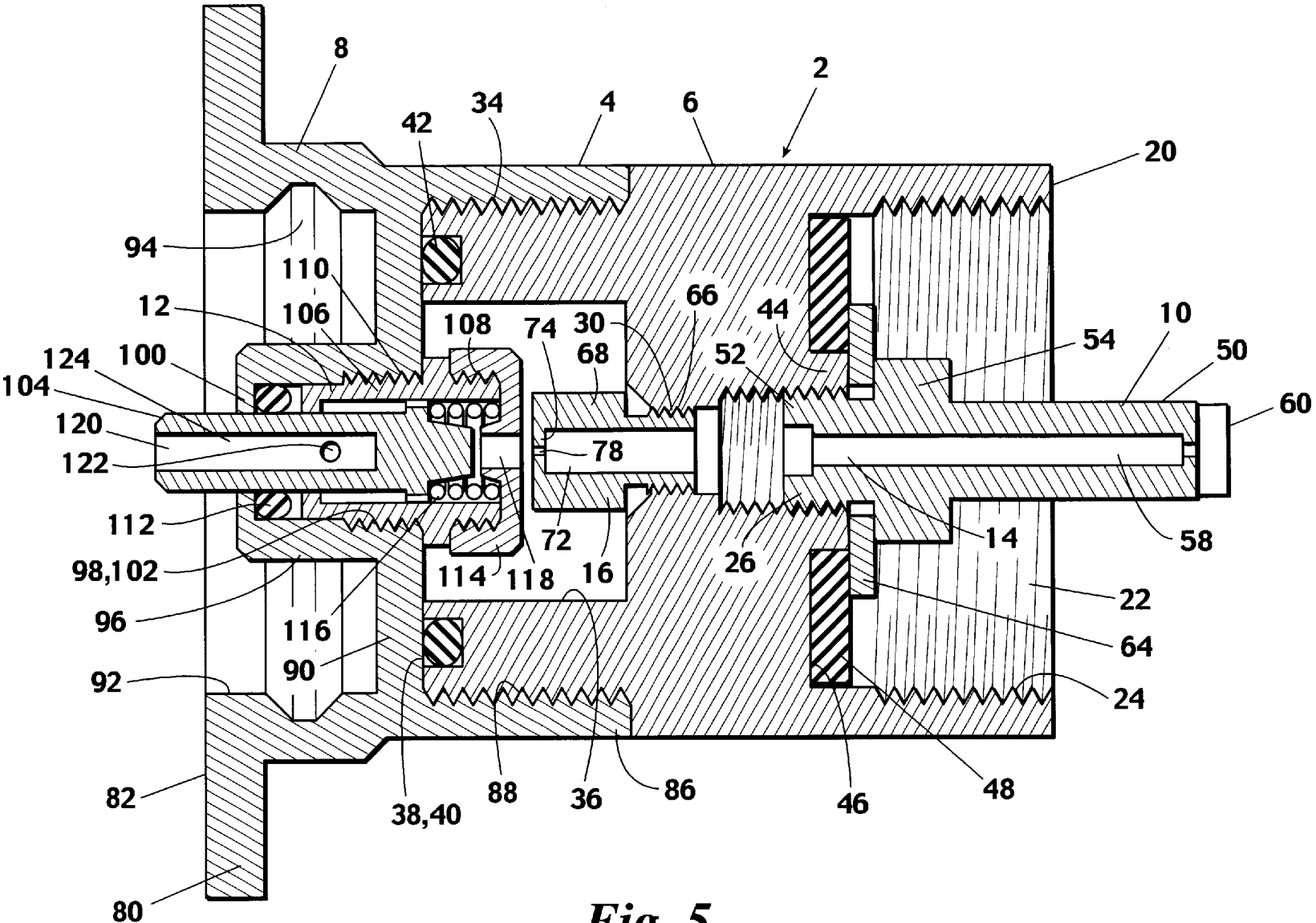
FIG. 5 provides a cutaway, elevational side view of inventive adaptor 2 wherein outlet valve 104 is in open position.

Valve stem 104 includes a flow passage 124 having an outlet port 120 provided at the forward end of valve stem 104 and an inlet port 122 provided through the side wall of the valve stem. Inlet port 122 is positioned such that, when inventive adaptor 2 is not attached to the gas burning device and valve stem 104 is thus held fully outward by spring 116, valve inlet port 122 will be positioned forwardly of O-ring 112. Thus, inlet port 122 will not be in fluid communication with the remainder of adaptor flow passage 114 so that valve assembly 12 will be closed. Valve assembly 12 is depicted in closed position in FIG. 4. As adaptor 2 is attached to the inlet fitting of the appliance, valve stem 104 is automatically pushed rearwardly to an open position wherein inlet port 122 is positioned within cage 106 behind O-ring 112. The open position of valve assembly 12 is depicted in FIG. 5.

Thus, when inventive adaptor 2 is fully assembled with inlet fitting 6 secured to the discharge coupling of a propane canister and outlet fitting 8 attached to the inlet fitting of a butane appliance, the entire flow passage 14 of inventive adaptor 2 is open such that the propane fuel flows into and through the flow channel 58 of probe 10, the flow channel 72 and flow restriction orifice 78 of orifice element 16, the aperture 118 of cap 114, the interior of valve cage 106, and the inlet port 122 of valve stem 104.

As will be apparent, the inlet 6 and outlet 8 fittings of inventive adaptor 2 could be configured to mate with any common type of gas discharge and appliance fittings. Additionally, other types of restriction elements suitable for restricting the flow and reducing the pressure of the gas flowing through the inventive adaptor will be apparent to those skilled in the art. Examples of such elements include needle valves or other types of valve elements, adjustable or fixed regulators, tubing of a length and inside diameter sufficient to obtain a desired restriction in flow, multiple orifice elements, etc.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An apparatus for burning propane in a butane-burning device, said propane having a supply pressure and said apparatus comprising:

an inlet fitting structured for attachment to a propane supply container;

an outlet fitting structured for attachment to a butane-burning device;

a flow valve provided in said outlet coupling and including a valve stem which will automatically depress when said outlet fitting is attached to said butane-burning device so that said flow valve is opened; and limiting means, between said flow valve and said inlet fitting, effective for limiting flow of and reducing said supply pressure of said propane such that said propane can be burned in said butane-burning device.

2. The apparatus of claim 5 wherein said limiting means is at least one flow restriction orifice.

3. The apparatus of claim 1 wherein said inlet fitting includes a probe structured for activating said propane supply container when said inlet fitting is attached to said propane supply container.

* * * * *

UNITED STATES PATENT AND TRADEMARK OFFICE

CERTIFICATE OF CORRECTION

PATENT NO. : 6,237,891 B1
DATED : May 29, 2001
INVENTOR(S) : Stiner, et al.

It is certified that error appears in the above-identified patent and that said Letters Patent is hereby corrected as shown below:

Claim 2,
Line 17, after the word "claim" the numeral 5 should be replaced by the numeral 1.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*